US012215447B2

(12) United States Patent
Henle et al.

(10) Patent No.: US 12,215,447 B2
(45) Date of Patent: Feb. 4, 2025

(54) AIR LAYING DEVICE

(71) Applicant: Voith Patent GmbH, Heidenheim (DE)

(72) Inventors: Tobias Henle, Ulm (DE); Alexander Gloning, Zöbingen (DE); Christian Kneissle, Kirchbierlingen (DE)

(73) Assignee: Voith Patent GmbH, Heidenheim (DE)

( * ) Notice: Subject to any disclaimer, the term of this patent is extended or adjusted under 35 U.S.C. 154(b) by 23 days.

(21) Appl. No.: 18/127,854

(22) Filed: Mar. 29, 2023

(65) Prior Publication Data

US 2023/0235493 A1 Jul. 27, 2023

Related U.S. Application Data

(63) Continuation of application No. PCT/EP2021/076003, filed on Sep. 22, 2021.

(30) Foreign Application Priority Data

Sep. 29, 2020 (DE) ..... 10 2020 125 404.0

(51) Int. Cl.
*D04H 1/732* (2012.01)
*D04H 1/26* (2012.01)
*D04H 1/28* (2012.01)

(52) U.S. Cl.
CPC ..... *D04H 1/732* (2013.01); *D04H 1/26* (2013.01); *D04H 1/28* (2013.01)

(58) Field of Classification Search
CPC ..... D04H 1/732; D04H 1/26; D04H 1/28
See application file for complete search history.

(56) References Cited

U.S. PATENT DOCUMENTS 2,221,262 A 11/1940 Mims et al.
2,931,076 A 4/1960 Clark
3,482,287 A 12/1969 Flewwelling
(Continued)

FOREIGN PATENT DOCUMENTS

DE 10 2019 114 037 A1 11/2020
EP 1464240 A1 * 10/2004 ..... A24D 3/0233
WO WO-2022123439 A1 * 6/2022 ..... D04H 1/425

OTHER PUBLICATIONS

German Office Action dated Jul. 27, 2021 for German Patent Application No. 10 2020 125 404.0 (8 pages).
(Continued)

*Primary Examiner* — Tajash D Patel
(74) *Attorney, Agent, or Firm* — Taylor IP, P.C.

(57) ABSTRACT

An air laying device for producing a fibrous mat at least partially from a plurality of fibers including at least one of a plurality of wood pulp fibers and a plurality of cellulose fibers, the air laying device including:

a ring distributor including a fiber feed and a ring channel, the ring channel including an outlet element forming a section of the ring channel; and a calming channel extending in a downward direction toward a forming fabric, the section being arranged within the calming channel, the outlet element including a plurality of openings configured for being that through which the plurality of fibers supplied by the fiber feed exit from the ring channel into the calming channel and move to the forming fabric to form the fibrous mat on the forming fabric.

13 Claims, 2 Drawing Sheets

(56) References Cited

U.S. PATENT DOCUMENTS

| | | | | |
|---|---|---|---|---|
| 4,153,488 | A * | 5/1979 | Wiegand | D04H 1/732 156/181 |
| 5,762,171 | A | 6/1998 | Mizer | |
| 5,930,871 | A * | 8/1999 | Raja | D01G 15/465 19/106 R |
| 6,363,580 | B1 | 4/2002 | Sørensen et al. | |
| 7,690,903 | B2 | 4/2010 | Norgaard et al. | |
| 11,306,439 | B2 * | 4/2022 | Higuchi | D21F 1/80 |
| 2004/0237269 | A1 | 12/2004 | Arnold et al. | |
| 2024/0141568 | A1 * | 5/2024 | Ehl | D21F 9/00 |

OTHER PUBLICATIONS

Notification of the Transmission of the International Search Report and Written Opinion of the International Search Authority or Declaration dated Jan. 18, 2022 for International Application No. PCT/EP2021/076003 (12 pages).

* cited by examiner

AIR LAYING DEVICE

CROSS REFERENCE TO RELATED APPLICATIONS

This is a continuation of PCT application no. PCT/EP2021/076003, entitled "AIR-LAYING DEVICE", filed Sep. 22, 2021, which is incorporated herein by reference. PCT application no. PCT/EP2021/076003 claims priority to German patent application no. 10 2020 125 404.0, filed Sep. 29, 2020, which is incorporated herein by reference.

BACKGROUND OF THE INVENTION

1. Field of the Invention

The present invention relates to an air laying device for producing a fibrous mat, including, at least partially, wood pulp fibers and/or cellulose fibers.

2. Description of the Related Art

Devices of this type are known. Initially, individual fibers or fiber agglomerates are produced and are distributed uniformly by way of an air stream on a forming fabric in order to form a fibrous mat. Air laying devices for laboratory operations are operated in batch mode. Individual fibrous mats, so-called fibrous mat sheets, are produced in a laboratory successively for further examination with respect to properties, for example mechanical properties. Such devices operate very slowly and must be hand-fed. The provision of single fibers by way of breaking down fiber agglomerates is particularly expensive.

Air laying devices which produce fibrous mat webs in continuous operation are also known. The provision of single fibers by way of breaking down fiber agglomerates is expensive also in this case.

The known devices also have the disadvantage that aggregates, for example powder, are difficult to mix uniformly with the fibers in the air stream. Secondly, it is difficult to process fibers with a large fiber length spectrum.

What is needed in the art is an air laying device which improves the known devices in regard to the described disadvantages.

SUMMARY OF THE INVENTION

The present invention provides an air laying device for producing a fibrous mat, consisting at least partially of wood pulp fibers and/or cellulose fibers, the air laying device including a ring distributor having a fiber feed, a ring channel with an outlet element forming a section of the ring channel, wherein said section is arranged within a calming channel extending in downward direction toward a forming fabric, and wherein the outlet element has openings through which fibers supplied by the fiber feed can exit from the ring channel into the calming channel and can move to the forming fabric to form the fibrous mat on said forming fabric.

The ring channel of the ring distributor is designed advantageously so that the fibers and possibly the fiber agglomerates and the aggregates move in an annular flow produced by an air stream. A portion of the fibers and, if present, a portion of the aggregates leave the ring channel via the outlet element and pass directly into the calming channel and then onto the forming fabric to form a fibrous mat or a fibrous mat web. In the annular flow the fiber agglomerates are broken down into individual fibers. Before the fibers leave the ring channel, they are optionally transported several times in a circle by the annular flow. The multiple circulations improve the breakdown of fiber agglomerates on the one hand and achieve a homogeneous mixture of the solids in the air stream on the other hand.

Wood pulp fibers and/or cellulose fibers and/or aggregates are fed advantageously into the air stream by the fiber feed.

In the area of the fiber feed, an air nozzle can be used as a propulsion jet nozzle to generate a negative pressure in the fiber feed.

In an advantageous embodiment, several air nozzles open into the ring channel to generate an air stream and to break down fiber agglomerates. On the one hand, this maintains and propels the annular flow, and on the other hand, the air jets of the air nozzles generate pressure pulses on the fiber agglomerates so that they are broken down.

In a possible further development of the present invention, cleaning nozzles are arranged outside of the ring channel for the purpose of cleaning the openings of the outlet element. These are optionally in the embodiment of air nozzles.

The air nozzles and/or cleaning nozzles can be supplied with a pulsating or oscillating air stream.

The air nozzles and/or the cleaning nozzles can be mounted fixed or movably. This allows the impetus of the annular flow as well as the cleaning effect to be adjusted. The movably mounted nozzles can be designed for oscillating movement.

The calming channel may terminate, providing a seal with the forming fabric or can be spaced at a distance from the forming fabric.

The calming channel can be supplied with an overpressure.

A suction device can be assigned to the forming fabric. This supports the deposit of fibers and a more compact fibrous mat can be produced.

The openings of the outlet element can have a maximum width of 10 mm.

The openings may be designed as a slot or can be round.

In a possible further development, the ring channel may contain mixing particles for mixing the fibers and breaking down of fiber agglomerates.

The air laying device can be designed to be suitable for laboratory use and the forming fabric can be arranged statically. The feed can be designed to be closable for this case. Thus, the production of a fibrous mat can be carried out in batch operation.

The air laying device can also be designed to be suitable for continuous production of fibrous mat webs, wherein the forming fabric can be movable in machine direction. Optionally, it is designed as a circulating belt guided over several rollers.

Additional characteristics and advantages of the present invention result from the following description of design examples with reference to the drawings.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawing, wherein.

Corresponding reference characters indicate corresponding parts throughout the several views. The exemplifications set out herein illustrate at least one embodiment of the invention, and such exemplifications are not to be construed as limiting the scope of the invention in any manner.

DETAILED DESCRIPTION OF THE INVENTION

Figure 1:
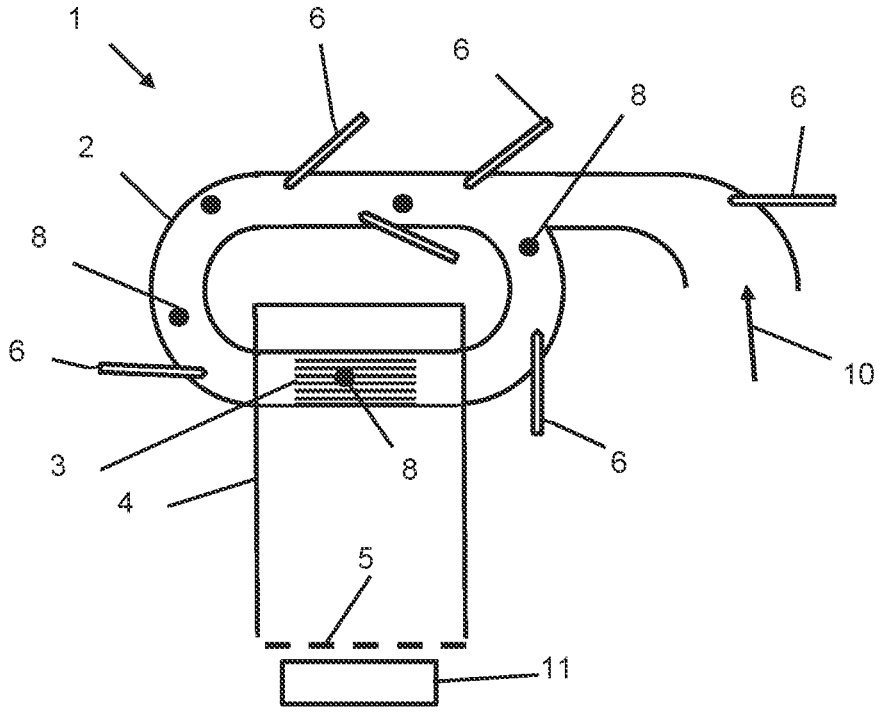
FIG. 1 shows an embodiment of a device according to the present invention with a ring distributor in simplified, schematic representation.

FIG. 1 shows an embodiment of a device according to the invention with a ring distributor 2 in simplified, schematic representation. Air laying device 1 serves to produce a fibrous mat, consisting at least partially of wood pulp fibers and/or cellulose fibers. It includes a ring distributor 2 with a ring channel and a fiber feed 10. The ring channel has a section formed by an outlet element 3 having openings through which the fibers supplied by fiber feed 10 can exit from the ring channel into calming channel 4 and move to forming fabric 5 in order to form the fibrous mat on forming fabric 5. In this example, outlet element 3 has slot-shaped openings whose dimensions are less than 10 mm in width and greater than 10 mm in length. The section with outlet element 3 is arranged in a calming channel 4 extending downward toward a forming fabric 5. The ring channel of ring distributor 2 is advantageously designed so that the fibers and, if necessary, the fiber agglomerates and aggregates move in an annular flow generated by an air stream. Some of the fibers and, if present, some of the aggregates leave the ring channel via outlet element 3 and pass directly into calming channel 4 and subsequently onto forming fabric 5 to form a fibrous mat in batch operation or a fibrous mat web in continuous operation. In the annular flow, the fiber agglomerates are broken down into individual fibers. Before the fibers leave the ring channel, they are optionally transported several times in a circle by the annular flow. The multiple circulations improve breaking down of fiber agglomerates on the one hand and achieve a homogeneous mixture of the solids in the air stream on the other hand. In the area of fiber feed 10 an air nozzle 6 is utilized as a propulsion jet nozzle to generate a negative pressure in the fiber feed in order to facilitate feeding of wood pulp fibers and/or cellulose fibers and/or aggregates into the annular flow of the ring channel. Along the ring channel of ring distributor 2, several air nozzles 6 open into the ring channel to generate an air flow and to break down fiber agglomerates. On the one hand, this maintains and propels the annular flow, and, on the other hand, the air jets of air nozzles 6 exert pressure pulses on the fiber agglomerates so that they are broken down into individual fibers. This effect is further supported in this example by mixing particles 8 intended for mixing the fibers and for breaking down fiber agglomerates. Calming channel 4 is arranged at a small distance from forming fabric 5. A suction device 11 is allocated to the forming fabric. This supports the deposit of fibers and a more compact fibrous mat, or respectively a more compact fibrous mat web can be produced.

Figure 2:
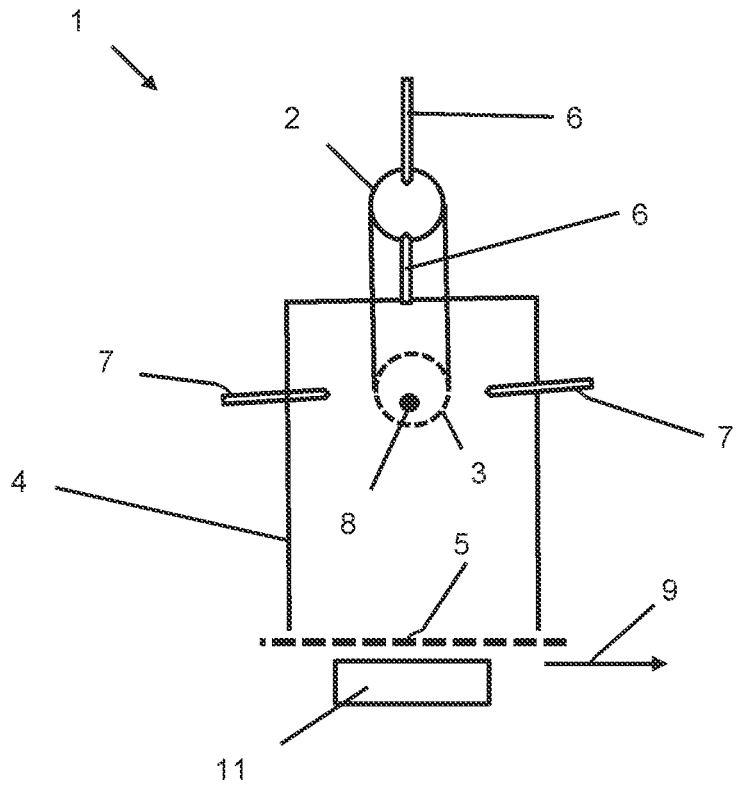
FIG. 2 shows a side view of the embodiment according to FIG. 1 in simplified, schematic representation.

FIG. 2 shows a side view of the embodiment according to FIG. 1 in simplified, schematic representation. Here, cleaning nozzles 7 which are supplied with compressed air or air from a blower for cleaning outlet element 3 are shown. To improve the cleaning effect, these can be arranged in a circular oscillating manner around an imaginary axis perpendicular to the drawing plane. It is also conceivable that they are arranged in an elliptically oscillating manner. It is moreover possible that the oscillating motion can be combined with a translatory motion. Illustrated air laying device 1 can be designed to be suitable for laboratory use and the forming fabric can be arranged statically. Illustrated air laying device 1 is designed to be suitable for continuous production of fibrous mat webs. In this case forming fabric 5 is movable in machine direction 9. Optionally, it is designed as a circulating belt guided over several rolls.

Corresponding elements in the drawings are identified with same reference numbers. The functions of such elements in the individual drawings correspond with each other unless otherwise described and no contradictions occur. A repeated description is therefore dispensed with.

Component Reference Listing

1 Air laying device
2 ring distributor
3 outlet element
4 calming channel
5 forming fabric
6 air nozzle
7 cleaning nozzle
8 mixing particles
9 machine direction
10 fiber feed
11 suction device While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An air laying device for producing a fibrous mat at least partially from a plurality of fibers including at least one of a plurality of wood pulp fibers and a plurality of cellulose fibers, the air laying device comprising:

a ring distributor including a fiber feed and a ring channel, the ring channel including an outlet element forming a section of the ring channel; and a calming channel extending in a downward direction toward a forming fabric, the section being arranged within the calming channel, the outlet element including a plurality of openings configured for being that through which the plurality of fibers supplied by the fiber feed exit from the ring channel into the calming channel and move to the forming fabric to form the fibrous mat on the forming fabric, the plurality of openings having a maximum width of 10 mm.

2. The air laying device according to claim 1, wherein the fiber feed is configured such that at least one of the plurality of wood pulp fibers, the plurality of cellulose fibers, and a plurality of aggregates are fed into an air stream of the air laying device by way of the fiber feed.

3. The air laying device according to claim 1, wherein the air laying device further includes a plurality of air nozzles which open into the ring channel and are configured for generating an air stream and for breaking down a plurality of fiber agglomerates.

4. The air laying device according to claim 3, wherein the air laying device further includes a plurality of cleaning nozzles which are arranged outside of the ring channel and are configured for cleaning the plurality of openings of the outlet element.

5. The air laying device according to claim 4, wherein at least one of the plurality of air nozzles and the plurality of cleaning nozzles are configured for being supplied with a pulsating air stream or an oscillating air stream.

6. The air laying device according to claim 5, wherein at least one of the plurality of air nozzles and the plurality of cleaning nozzles are mounted fixed or movably.

7. The air laying device according to claim 1, wherein the calming channel terminates and (a) thereby is configured for providing a seal with the forming fabric or (b) is spaced at a distance from the forming fabric.

8. The air laying device according to claim 1, wherein the air laying device further includes a suction device which is configured for being allocated to the forming fabric.

9. The air laying device according to claim 1, wherein each of the plurality of openings are configured as a slot or as being round.

10. The air laying device according to claim 1, wherein the ring channel includes a plurality of mixing particles for mixing the plurality of fibers and breaking down of a plurality of fiber agglomerates.

11. A device, comprising:

a forming fabric, which is arranged statically; and an air laying device for producing a fibrous mat at least partially from a plurality of fibers including at least one of a plurality of wood pulp fibers and a plurality of cellulose fibers, the air laying device including:

a ring distributor including a fiber feed and a ring channel, the ring channel including an outlet element forming a section of the ring channel; and a calming channel extending in a downward direction toward the forming fabric, the section being arranged within the calming channel, the outlet element including a plurality of openings configured for being that through which the plurality of fibers supplied by the fiber feed exit from the ring channel into the calming channel and move to the forming fabric to form the fibrous mat on the forming fabric, the plurality of openings having a maximum width of 10 mm, the air laying device being configured for a laboratory use.

12. The device according to claim 11, wherein the air laying device is configured for continuously producing a plurality of fibrous mat webs, and the forming fabric is configured for moving in a machine direction.

13. The device according to claim 12, wherein the forming fabric forms an endless loop.

* * * * *